US007798887B2

(12) United States Patent
McKee et al.

(10) Patent No.: US 7,798,887 B2
(45) Date of Patent: Sep. 21, 2010

(54) UNDERWIRE BRASSIERE

(76) Inventors: Mercy L. McKee, 33 Club House Ave., #1, Venice, CA (US) 90291; Weston P. Headley, 22603 NE. 231st Ave., Battle Ground, WA (US) 98604

( * ) Notice: Subject to any disclaimer, the term of this patent is extended or adjusted under 35 U.S.C. 154(b) by 507 days.

(21) Appl. No.: 10/557,007

(22) PCT Filed: Jul. 6, 2004

(86) PCT No.: PCT/US2004/021645

§ 371 (c)(1),
(2), (4) Date: Nov. 27, 2007

(87) PCT Pub. No.: WO2005/020728

PCT Pub. Date: Mar. 10, 2005

(65) Prior Publication Data

US 2009/0042478 A1 Feb. 12, 2009

Related U.S. Application Data

(60) Provisional application No. 60/484,694, filed on Jul. 3, 2003.

(51) Int. Cl.
*A41C 3/00* (2006.01)

(52) U.S. Cl. ..... 450/41; 450/45

(58) Field of Classification Search ..... 450/14, 450/45–53, 61, 64, 82–86, 88; 2/255–260, 2/262, 264

See application file for complete search history.

(56) References Cited

U.S. PATENT DOCUMENTS

| | | | | | |
|---|---|---|---|---|---|
| 2,463,319 | A | * | 3/1949 | Schwartz | 450/45 |
| 2,520,009 | A | * | 8/1950 | Kramer | 450/48 |
| 2,613,365 | A | * | 10/1952 | Fairbanks et al. | 2/302 |
| 2,638,596 | A | * | 5/1953 | Fridolph | 450/82 |
| 3,312,223 | A | * | 4/1967 | Wilson | 450/45 |
| 3,608,556 | A | * | 9/1971 | Paterson | 450/48 |
| 4,275,740 | A | * | 6/1981 | Weston | 450/45 |

* cited by examiner

*Primary Examiner*—Gloria Hale
(74) *Attorney, Agent, or Firm*—Christie, Parker & Hale, LLP

(57) ABSTRACT

A breast-supporting garment (10) having a pair of centrally joined breast cups (12, 13), each cup having a generally U-shaped underwire (23, 24) extending along a bottom edge and upwardly along inner and outer side edges thereof, each underwire having a substantially straight central section (31, 32), the straight sections being held in abutment to provide enhanced support of the breasts.

9 Claims, 4 Drawing Sheets

FIG. 1
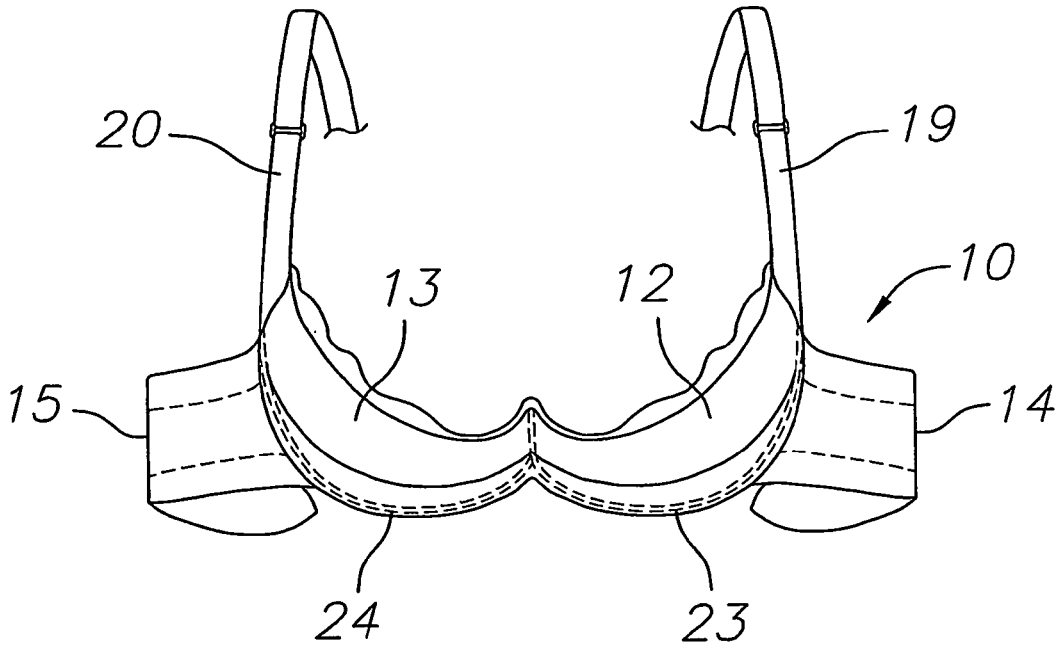
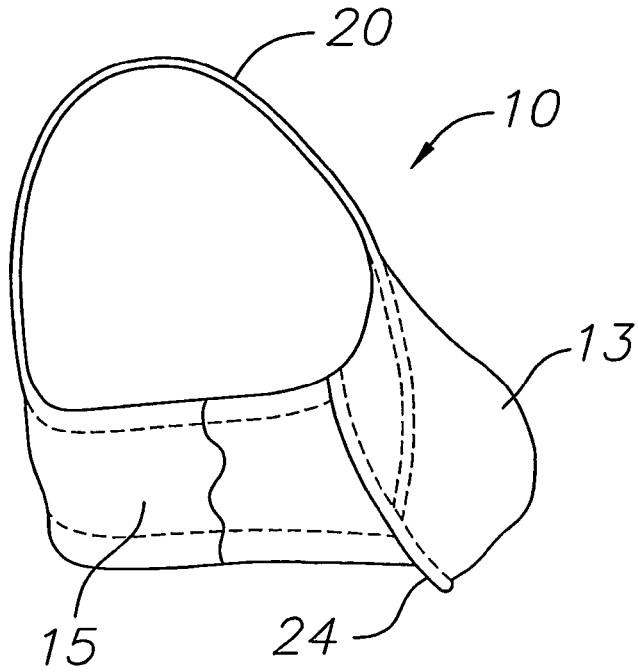
FIG. 2

FIG. 3
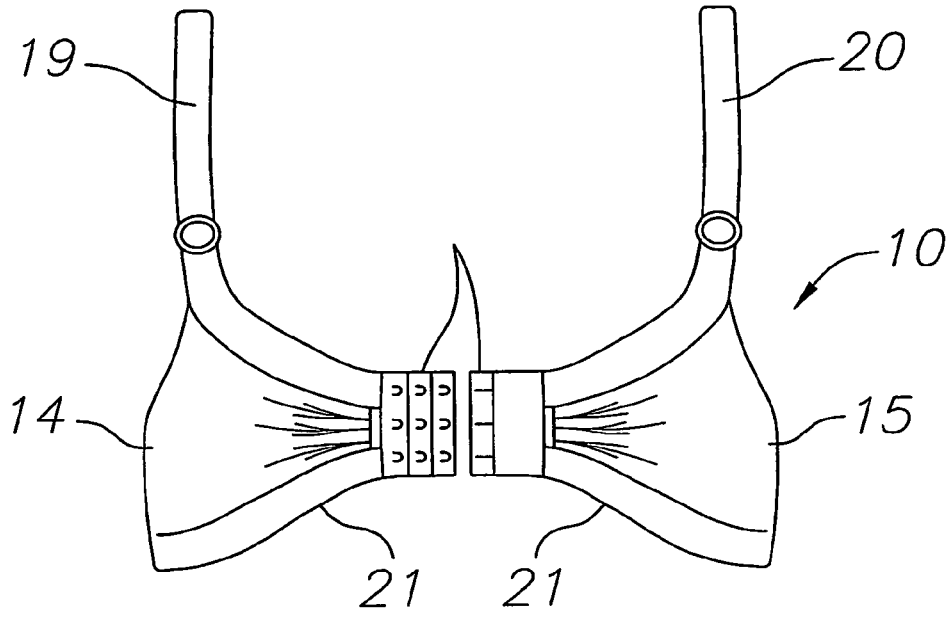
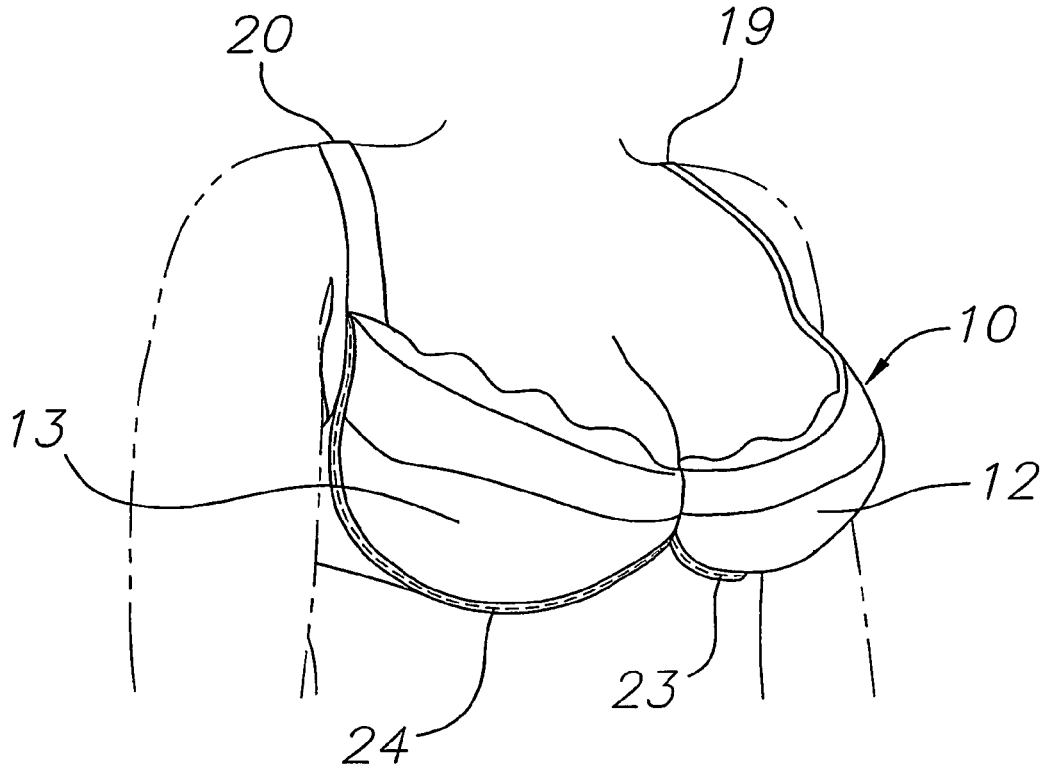
FIG. 4

FIG. 6
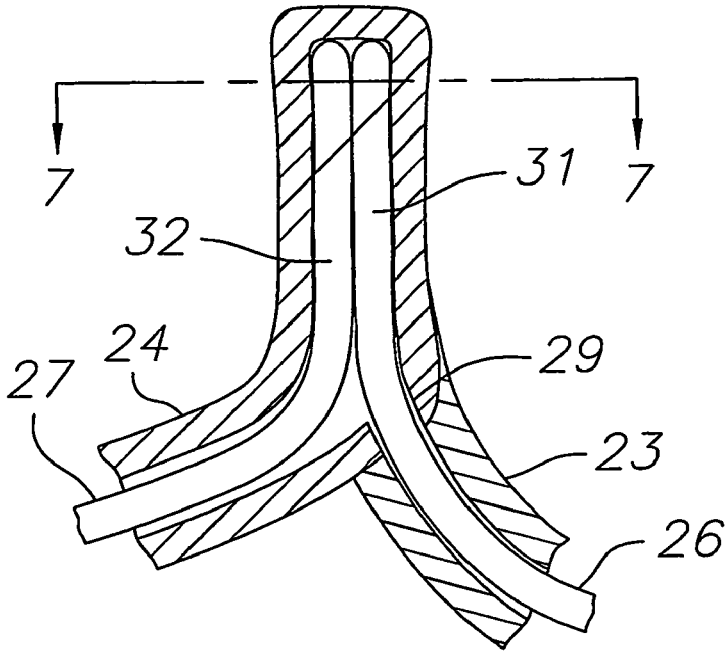
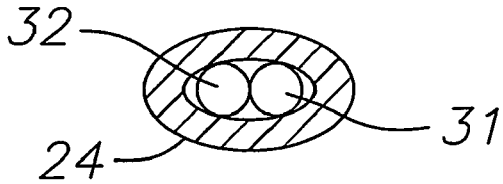
FIG. 7
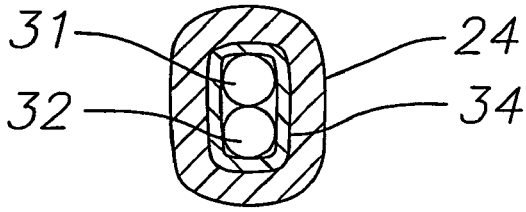
FIG. 8
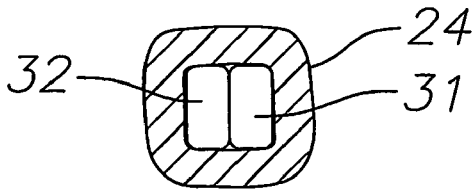
FIG. 9

UNDERWIRE BRASSIERE

CROSS-REFERENCE TO RELATED APPLICATION(S)

This application claims the benefit of U.S. Provisional Application Ser. No. 60/484,694 filed Jul. 3, 2003, the disclosure of which is incorporated herein by reference.

BACKGROUND OF THE INVENTION

This invention relates to an improved breast-supporting garment, and is described primarily in terms of an underwire brassiere (hereinafter "bra"), which is modified by positioning upper central sections of left and right underwires against each other to provide increased and comfortable support of the breasts. The invention is not limited to back- and shoulder-strap bras, and is applicable to underwire breast cups which are incorporated in strapless bras, corsets, swimwear, dresses, and other breast-supporting garments.

Underwire bras have left and right breast cups each having a hollow lining or casing, typically of sewn fabric, and extending from an inner central part of the cup, around the bottom of the cup, and upwardly along at least a portion of the cup outer edge. An underwire (typically metal, but could also be plastic, or a tightly compressed and stiff strand of cotton or a similar material) is inserted in each casing channel to facilitate positioning and increased support of the breasts. The fabric casing is not an essential feature, and other attachment methods such as sewing or gluing can be used to secure the underwire to the breast-cup edge.

Prior-art bra designs use two separated underwires which are not in contact, or are in only point contact at the underwire ends. Such point contact provides little mutual lateral support of the underwire and breast cups.

It has been found that a significant improvement in breast support can be achieved by providing underwires with overlapping straight and upwardly extending inner sections which are either secured in direct tangential and parallel contact with each other, or so held firmly together by an enclosing tube-like capsule. The abutted inner sections provide significantly additional lateral and vertical support for the underwires, cups, and breasts, and the design is especially advantageous with larger breast cups. Such larger sizes can also be of a demi-cup configuration for a more revealing cleavage, and a smaller amount of cup material.

SUMMARY OF THE INVENTION

A breast-supporting garment such as a bra, the garment having side-by-side and centrally joined breast cups, each cup having a generally U-shaped underwire fitted along a bottom edge, and extending upwardly along inner and outer side edges of the cup. The underwires have upper central sections which are abutted tangentially together in parallel alignment to provide enhanced support to each other, and to the cups. In a bra configuration, the garment preferably has a backstrap with a lower edge which is upwardly arched to resist upward movement of the backstrap.

BRIEF DESCRIPTION OF THE DRAWINGS

FIG. 1 is a front view of a demi-cup bra incorporating the invention;

FIG. 2 is a side view of the bra;

FIG. 3 is a back view of the bra;

FIG. 4 is a perspective of the bra as worn;

FIG. 6 is a sectional view of the components shown in FIG. 5;

FIG. 7 is a sectional view on line 7-7 of FIG. 6;

FIG. 8 is a view similar to FIG. 7, but showing underwires one above the other;

FIG. 9 is a view similar to FIG. 7, and showing underwires of a rectangular cross-section.

DETAILED DESCRIPTION OF THE INVENTION

Figure 5:
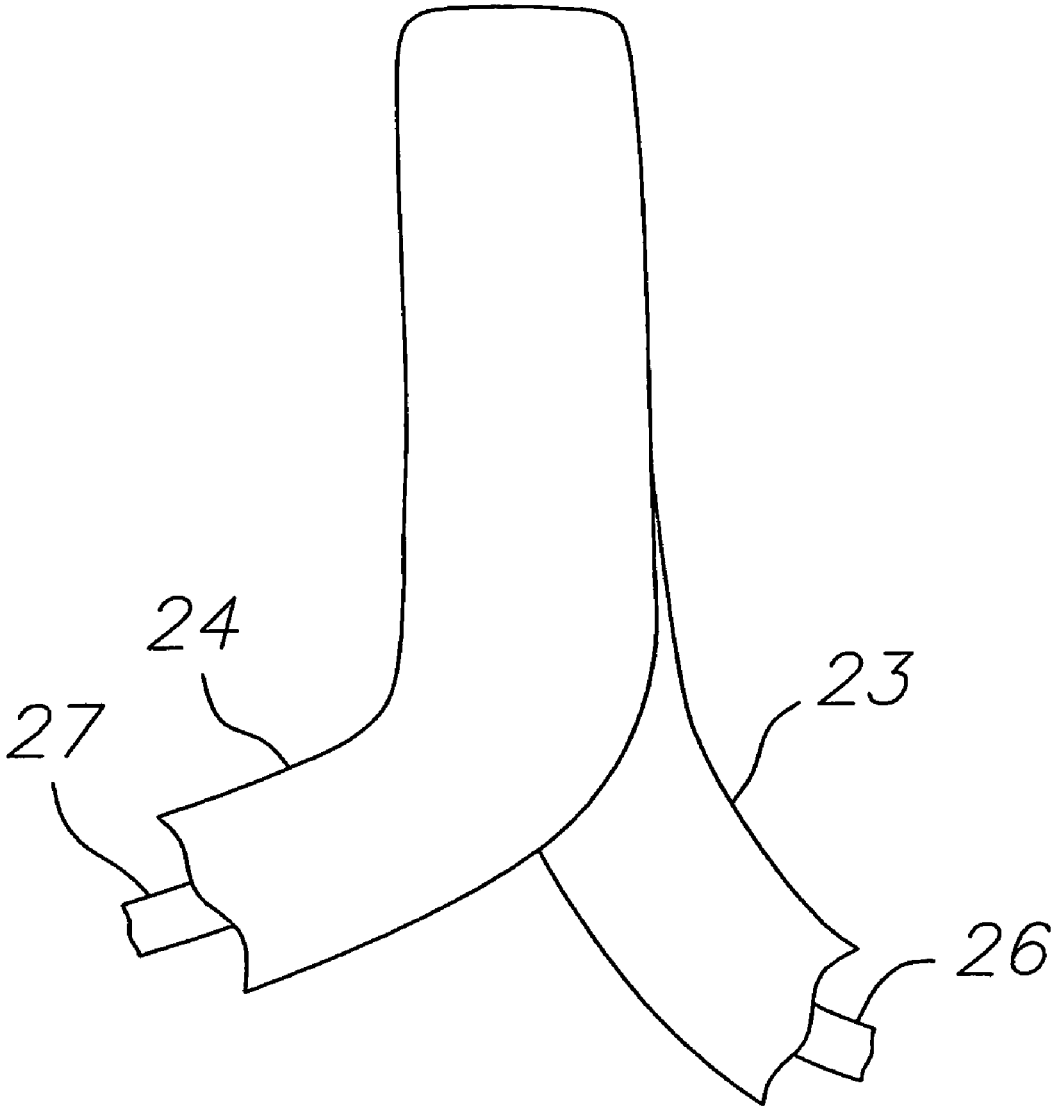
FIG. 5 is an enlarged front view of centrally joined underwires and enclosing casings.

Referring to FIGS. 1-4, an underwire bra 10 has centrally joined left and right breast cups 12 and 13, shown as demi-cups, but the invention is equally applicable to full-cup bras. Left and right backstraps 14 and 15 extend from the cups to encircle the user's chest, and be joined by a conventional rear fastener 16. Left and right shoulder straps 19 and 20 are secured to the upper outer edges of the cups to extend over the user's shoulders, and be joined to the backstraps (FIG. 3). The invention is also useful in bras which lack shoulder straps, and rely on backstraps, cups, and underwires for breast support.

Rear lower-edge portions 21 of the backstraps are upwardly arched, in contrast to the straight and generally horizontal lower edges of conventional bra backstraps. This arched configuration provides added resistance to "riding up" of the connected backstraps, and is especially helpful with bras using large cup sizes.

As shown in FIGS. 1, 2, and 4, the underside of the breast cups have sewn thereto casings 23 and 24, typically of a thick fabric, and with hollow interiors to accept left and right underwires 26 and 27 (shown in phantom line in FIG. 1). The casings and underwires extend downwardly along the outer side edges of cups 12 and 13, around the undersurface of the cups, and then merge upwardly in the central junction of the cups. For comfort, a slightly elastic fabric is preferred for the casings, but an elastomeric or plastic tubing can also be used. Hollow casings are conventionally used in underwire bras, but other means such as gluing or sewing can also be used to attach underwires to cups.

FIG. 6 is a sectional view of joined casings 23 and 24, with underwires 26 and 27 fitted therein. The upper central sections of the casings are sewn together, and a buttonhole-like window or opening 29 is formed in the inner sidewall of casing 24. Stitching closes the channel of casing 23 above the opening, forcing the upper inner section of underwire 26 into the channel of casing 24 to be tangent to and against the upper inner section of underwire 27. The fabric or other material forming the casings is sufficiently flexible to accept both wires, and to hold them in tight engagement as shown in the sectional view of FIG. 7.

As illustrated, upper inner sections 31 and 32 of the underwires are substantially straight, and these straight sections are at least about one-half inch in length, and preferably longer. The longer the tangential joint of the sections 31 and 32, the more mutual support is provided to the underwires and breast cups. Sections 31 and 32 can be rigidly connected (as by welding, twisting, and gluing, or being integrally formed), but this prevents folding of the bra for storage or shipment, and abutting ends which can be twisted during folding are accordingly preferred.

The underwires are typically made of a metal such as stainless steel, which is rigid and only slightly flexible. Plastic or other materials having these characteristics can also be used to make the underwires. Underwires having a circular cross section are shown in FIGS. 6-8, but a rectangular cross section (FIG. 9) also is entirely acceptable, and typical dimensions are 0.10 inch by 0.024 inch. Other cross sections such as half round can also be used.

Fore-and-aft overlapping of upper sections 31 and 32 as shown in FIG. 8 will provide the best support if encased in a short and close-fitting elastomeric or plastic tube 34 urging the wires into tight engagement. Preferably, the upper sections are laterally against each other as shown in FIGS. 7 and 9, the casing again urging the sections against each other.

What is claimed is:

1. An underwire bra having a pair of side-by-side breast cups, a backstrap with two ends wherein each end extends from each cup to encircle a wearer's body, each cup having a generally U-shaped underwire secured thereto, each of the two U-shaped underwires being held in a fixed position with their inner breast ends parallel along an upper portion of each underwire such that the upper inner breast end of the first underwire is in physical abutment with the upper inner breast end of the second underwire for a predetermined length greater than a single point of abutment.

2. The bra of claim 1 wherein the upper portion of each inner breast end of each underwire abuts each other for at least one-half inch.

3. The bra of claim 2 wherein the upper portion of each inner breast end of each underwire abut in a lateral side-by-side relationship.

4. The bra of claim 2 wherein the upper portion of each inner breast end of each underwire abut in a fore-and-aft relationship.

5. The bra of claim 2 wherein each cup has a hollow casing extending along a bottom edge and upwardly along inner and outer side edges of the cup, the underwire being fitted within the casing.

6. The bra of claim 5 wherein the casing is reinforced with a resilient tube inside the casing and enclosing the two underwire upper interior portions.

7. The bra of claim 2, wherein the backstrap has an upwardly arched lower edge to resist upward movement of the backstrap when worn.

8. A breast supporting garment leaving a pair of centrally joined and side-by-side breast cups, each cup having a generally U-shaped underwire secured thereto and extending downwardly from an upper central part of the cup, along a curved bottom of the cup, and upwardly along a portion of a laterally outer part of the cup, each of the two U-shaped underwires being fitted in a hollow sleeve extending along each cup from a lateral end of each cup to the inner end of each underwire at the center of the garment between the wearer's breasts and held in a fixed position with their inner breast ends parallel along an upper portion of each underwire such that the upper inner breast end of the first underwire is in physical abutment with the upper inner breast end of the second underwire for a predetermined length greater than a single point of abutment to provide added support to the cups.

9. The garment of claim 8, wherein the inner breast ends of the underwires are straight and at least about one-half inch long.

* * * * *